US007583027B2

(12) United States Patent
Joo

(10) Patent No.: US 7,583,027 B2
(45) Date of Patent: Sep. 1, 2009

(54) PLASMA DISPLAY APPARATUS

(75) Inventor: Hyung Dal Joo, Daejeon-si (KR)

(73) Assignee: LG Electronics Inc., Seoul (KR)

( * ) Notice: Subject to any disclaimer, the term of this patent is extended or adjusted under 35 U.S.C. 154(b) by 360 days.

(21) Appl. No.: 11/330,385

(22) Filed: Jan. 12, 2006

(65) Prior Publication Data

US 2006/0197449 A1 Sep. 7, 2006

(30) Foreign Application Priority Data

Jan. 13, 2005 (KR) ..... 10-2005-0003471

(51) Int. Cl.
*H01J 17/49* (2006.01)

(52) U.S. Cl. ..... 313/587; 313/586

(58) Field of Classification Search ..... 313/582–587
See application file for complete search history.

(56) References Cited

U.S. PATENT DOCUMENTS

| | | | | |
|---|---|---|---|---|
| 6,812,641 | B2 * | 11/2004 | Fujitani et al. | 313/587 |
| 7,362,051 | B2 * | 4/2008 | Kweon | 313/586 |
| 2002/0047566 | A1 | 4/2002 | Kim et al. | 315/169.3 |
| 2004/0174120 | A1 * | 9/2004 | Fujitani | 313/586 |
| 2004/0189200 | A1 | 9/2004 | Park et al. | 313/582 |

FOREIGN PATENT DOCUMENTS

| | | |
|---|---|---|
| CN | 1509489 A | 6/2004 |
| EP | 1 387 386 A1 | 2/2004 |
| JP | 2001-307654 | 11/2001 |
| JP | 2003-331734 | 11/2003 |

OTHER PUBLICATIONS

English Translation KR 2001048517A.*
KR 20011048517A.*
Korean Office Action Sep. 27, 2006.
European Search Report dated Jul. 27, 2006.
Chinese Office Action dated Oct. 31, 2008.

* cited by examiner

*Primary Examiner*—Sikha Roy
*Assistant Examiner*—Mary Ellen Bowman
(74) *Attorney, Agent, or Firm*—KED & Associates, LLP

(57) ABSTRACT

A plasma display apparatus is provided. The plasma display apparatus may include an upper substrate positioned facing a lower substrate, an upper electrode pair including a scan electrode and a sustain electrode formed on the upper substrate, an address electrode formed on the lower substrate, and at least one barrier rib positioned between the upper substrate and the lower substrate. A dielectric layer may be formed on the upper substrate, covering the upper electrode pair. In certain embodiments, a dielectric constant of a portion of the dielectric layer in an area between the scan electrode and the sustain electrode may be different from a portion of the dielectric layer in an area that overlaps the scan electrode and the sustain electrode. In alternative embodiments, a dielectric constant of a portion of the dielectric layer in an area that overlaps the at least one barrier rib may be different from a dielectric constant in an area that does not overlap the at least one barrier rib. In this manner, parasitic capacitance may be reduced, and a magnitude of a voltage required for discharge may be reduced, thus reducing power consumption.

6 Claims, 16 Drawing Sheets

PLASMA DISPLAY APPARATUS

BACKGROUND OF THE INVENTION

1. Field of the Invention

The present invention relates to a plasma display apparatus, and more particularly, to a plasma display apparatus which can lower a discharge voltage by decreasing parasitic capacitance of a panel, thereby reducing power consumption.

2. Description of the Background Art

A cathode ray tube (CRT) or a Braun tube which has been mainly used up to now has a defect of a large weight and a large volume. Therefore, various kinds of flat panel displays (FPD) which can overcome the limit of such a cathode ray tube have been developed.

As a flat panel display, there are a liquid crystal display (LCD), a plasma display panel (hereinafter, referred to as "PDP"), a field emission display (FED), an electro luminescence (EL), etc.

Among such a flat panel display, a PDP which can easily manufacture a large size of panel has been in the spotlight. A PDP displays an image and moving images including a character or a graphic by allowing a phosphor to emit light by ultraviolet rays of 147 nm generating upon discharging of He+Xe, Ne+Xe, and He+Ne+Xe gas. Such a PDP displays an image by adjusting a discharge period of each pixel depending on video data and provides a picture quality which is greatly improved thanks to the recent technical development.

Specifically, a three-electrode AC surface-discharge PDP lowers a voltage required for discharge by accumulating wall charges using a dielectric layer upon discharging and protects electrodes from sputtering of plasma, so that it has an advantage of a low voltage drive and a long lifetime.

FIG. 1 is a perspective view illustrating a discharge cell of a three-electrode AC surface-discharge PDP in the related art.

Referring to FIG. 1, the discharge cell of the three-electrode AC surface-discharge PDP includes a scan electrode (Y) and a sustain electrode (Z) which are formed on an upper substrate 10 and an address electrode (X) which is formed on a lower substrate 18. Each of the scan electrode (Y) and the sustain electrode (Z) includes transparent electrodes (12Y, 12Z) and metal bus electrodes (13Y, 13Z) which have a line width smaller than that of the transparent electrode (12Y, 12Z) and which are formed in one edge of the transparent electrode.

The transparent electrodes (12Y, 12Z) are generally made of a metal such as an indium tin oxide (ITO), an indium zinc oxide (IZO), and an indium tin zinc oxide (ITZO) and formed on the upper substrate 10. The metal bus electrodes (13Y, 13Z) are generally made of a metal such as chrome (Cr) and formed on the transparent electrodes (12Y, 12Z) to reduce a drop in voltage by the transparent electrodes (12Y, 12Z) having high resistance. An upper dielectric layer 14 and a protective film 16 are stacked in the upper substrate 10 in which the scan electrode (Y) and the sustain electrode (Z) are formed in parallel.

The protective film 16 prevents damage of the upper dielectric layer 14 by sputtering generated upon discharging plasma and increases emission efficiency of a secondary electron. A magnesium oxide (MgO) is generally used as the protective film 16.

A lower dielectric layer 22 and a barrier rib 24 are formed on a lower substrate 18 in which the address electrode (X) is formed and a phosphorous layer 26 is coated on the surface of the lower dielectric layer 22 and the barrier rib 24. The address electrode (X) is formed in a direction to intersect the scan electrode (Y) and the sustain electrode (Z).

Wall charges formed due to discharge are stacked in the upper dielectric layer 14 and the lower dielectric layer 22. The dielectric layers 14 and 22 and the protective film 16 can lower a discharge voltage applied from the outside.

The barrier rib 24 and the upper and lower substrates 10 and 18 form a discharge space. The barrier rib 24 is formed in parallel to the address electrode 20 and prevents ultraviolet rays and visible rays generated by gas discharge from being leaked to an adjacent discharge cell. An inert gas such as He, Ne, Ar, Xe, and Kr for gas discharge, a discharge gas (or mixed gas) with which these gases are combined, or an excimer gas which can generate ultraviolet rays due to discharge are filled in a discharge space formed between the upper and lower substrates 10 and 18 and the barrier rib 24.

The phosphorous layer 26 is excited by ultraviolet rays generated upon discharging plasma and generates any one visible ray of red color (R), green color (G) or blue color (B).

FIG. 2A shows a barrier rib and an upper substrate in the related art and FIG. 2B shows parasitic capacitance formed in the barrier rib in the related art.

As shown in FIG. 2A, in a PDP in the related art, the scan electrode (Y) and the sustain electrode (Z) are formed in the upper substrate 10 and the dielectric layer 14 is formed to cover the scan electrode (Y) and the sustain electrode (Z) and the upper substrate 10. As the barrier rib 24 is positioned in a right lower portion of the protective film 16 after the protective film 16 is coated on the dielectric layer 14, the discharge space is partitioned.

As shown in FIG. 2B, the scan electrode (Y) and the sustain electrode (Z) formed in a direction intersecting the barrier rib 24 are positioned in this portion and charges are charged by a driving signal applied to the scan electrode (Y) and the sustain electrode (Z). That is, parasitic capacitance is formed by elements having a dielectric constant around the electrodes (Y, Z).

The dielectric layer 14 and the protective film 16 which are formed between the barrier rib 24 and the upper substrate 10 and the upper substrate 10 form parasitic capacitance of a non-discharge area. This is because dielectric constants of glass, the dielectric layer 14, and the protective film 16 which are used as a material of the upper substrate 10 are different from each other. Among them, because parasitic capacitance (Cs) between electrodes generated in the protective film 16 is much smaller than parasitic capacitances (C, Cg) generated in the upper substrate 10 or the dielectric layer 14, it does not greatly matter.

In addition, the parasitic capacitance (Cg) between electrodes generated in the upper substrate 10 is greatly improved by recently adopting a glass substrate having a low dielectric constant.

Even in the dielectric layer 14, the parasitic capacitance (C) is generated between the electrodes (Y, Z). Specifically, a portion shown in FIG. 2B is an area which partitions a discharge space as the barrier rib 24 and the upper substrate 10 come in contact with each other and is a non-discharge area which discharge is not generated. The dielectric layer 14 in the discharge area serves as lowering a discharge voltage by charging wall charges upon discharging, but there is a problem that the dielectric layer 14 in the non-discharge area increases a magnitude of a voltage required for discharge by the parasitic capacitance (C) that is not concerned in the discharge. In addition, if a magnitude of a voltage required upon discharging increases, there is a problem that consumption power increases in an entire plasma display panel.

SUMMARY OF THE INVENTION

Accordingly, an object of the present invention is to solve at least the problems and disadvantages of the background art.

An object of the present invention is to provide a plasma display apparatus which lowers a discharge voltage by reducing parasitic capacitance of a panel.

According to an aspect of the present invention, there is provided a plasma display apparatus including: an upper electrode pair including a scan electrode and a sustain electrode which are formed on an upper substrate; an address electrode which is formed on a lower substrate opposite to the upper substrate; a barrier rib formed between the upper substrate and the lower substrate; and a dielectric layer on the upper substrate to cover the upper electrode pair and in which a dielectric constant between the scan electrode and the sustain electrode is different from that on the scan electrode and the sustain electrode.

According to another aspect of the present invention, there is provided a plasma display apparatus including: an upper electrode pair including a scan electrode and a sustain electrode which are formed on an upper substrate; an address electrode formed on a lower substrate opposite to the upper substrate; a barrier rib formed between the upper substrate and the lower substrate; and a dielectric layer which is formed in the upper substrate to cover the upper electrode pair and in which a dielectric constant in an area which is overlapped with the barrier rib is different from that in an area which is not overlapped with the barrier rib.

According to still another aspect of the present invention, there is provided a plasma display apparatus including: an upper electrode pair including a scan electrode and a sustain electrode which are formed on an upper substrate; an address electrode formed on a lower substrate opposite to the upper substrate; a barrier rib formed between the upper substrate and the lower substrate; and a dielectric layer which is formed on the upper substrate to cover the upper electrode pair, in which a dielectric constant between the scan electrode and the sustain electrode is different from that on the scan electrode and the sustain electrode, and in which a dielectric constant in an area which is overlapped with the barrier rib is different from that in an area which is not overlapped with the barrier rib.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Hereinafter, exemplary embodiments of the present invention will be described in detail with reference to the accompanying drawings.

In a first embodiment to a third embodiment, parasitic capacitance is lowered by lowering a dielectric constant between the scan electrode and the sustain electrode, in a fourth embodiment to a sixth embodiment, parasitic capacitance is lowered by lowering a dielectric constant of a dielectric layer in a portion overlapped with the barrier rib, and in a seventh embodiment to a ninth embodiment, parasitic capacitance is lowered by lowering a dielectric constant of a portion overlapped with the barrier rib as well as a portion between electrodes.

Figure 1:
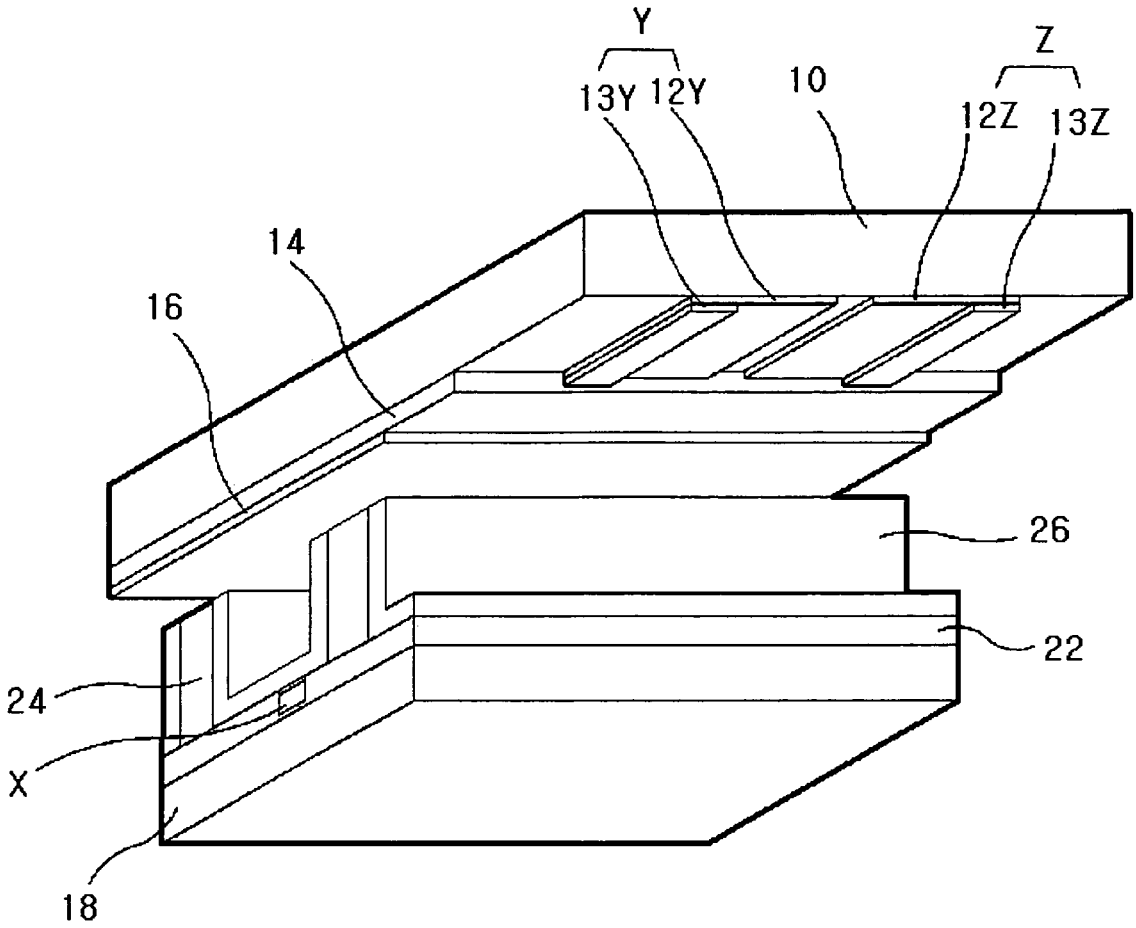
Fig.1 (related art)
FIG. 1 is a view illustrating a structure of a plasma display apparatus in the related art.
Figure 2A:
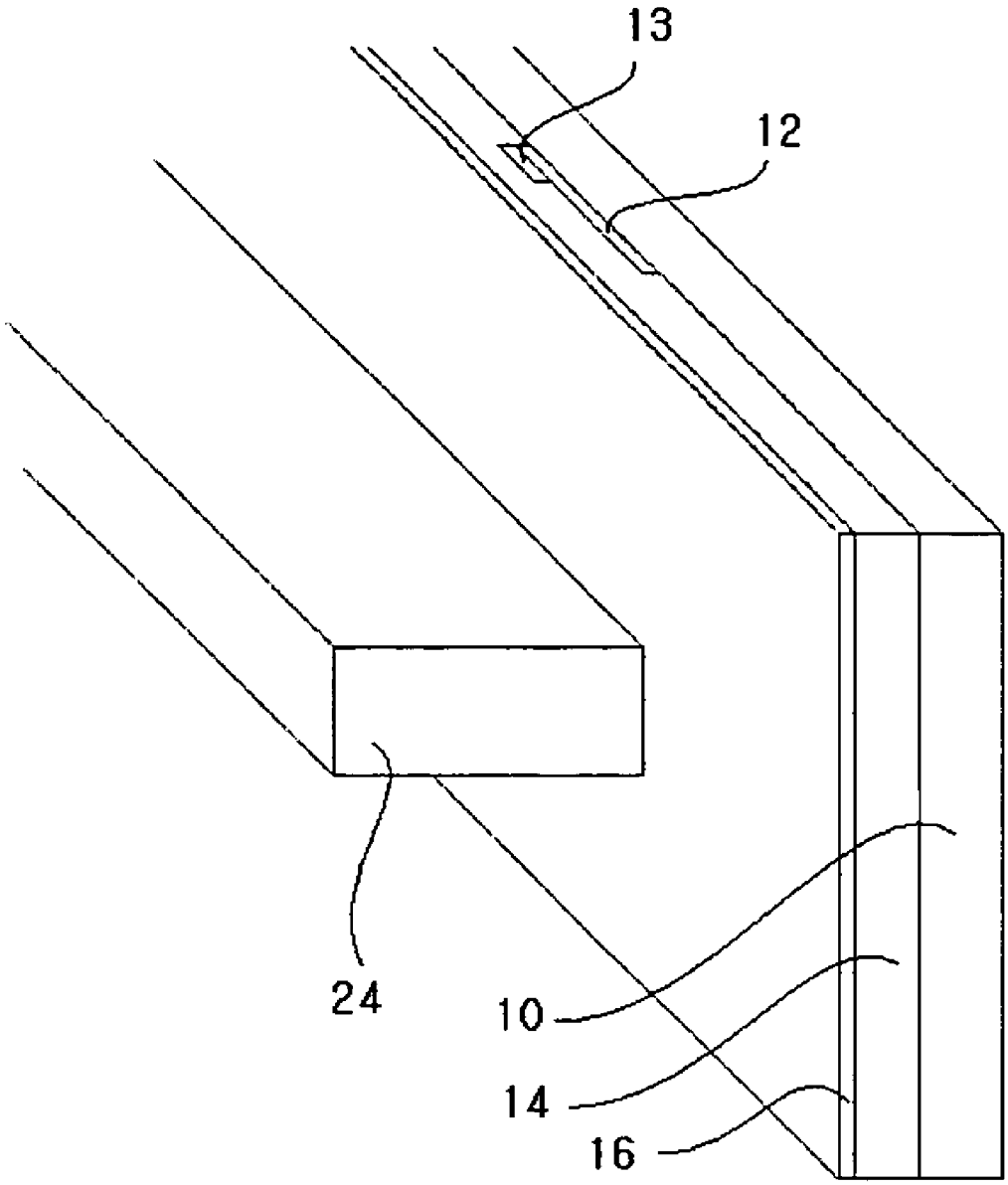
Fig.2A (related art)
FIG. 2A is a view illustrating a barrier rib and a upper substrate in the related art.
Figure 2B:
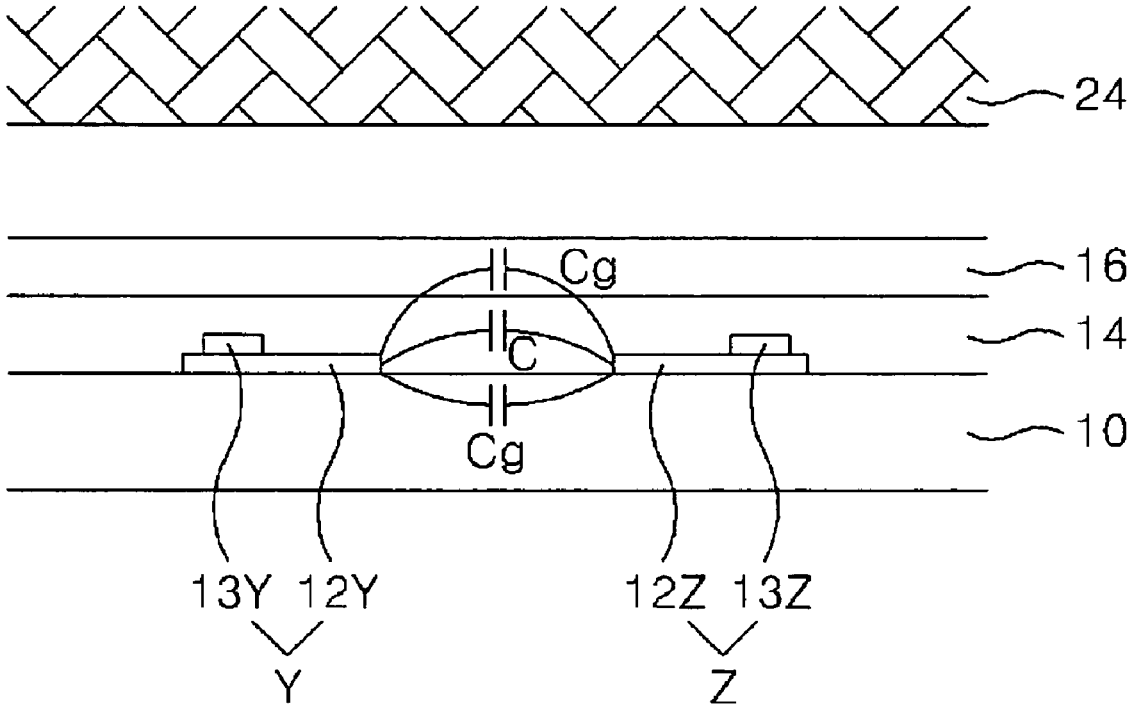
Fig.2B (related art)
FIG. 2B is a view illustrating parasitic capacitance formed in a barrier rib in the related art.
Figure 3:
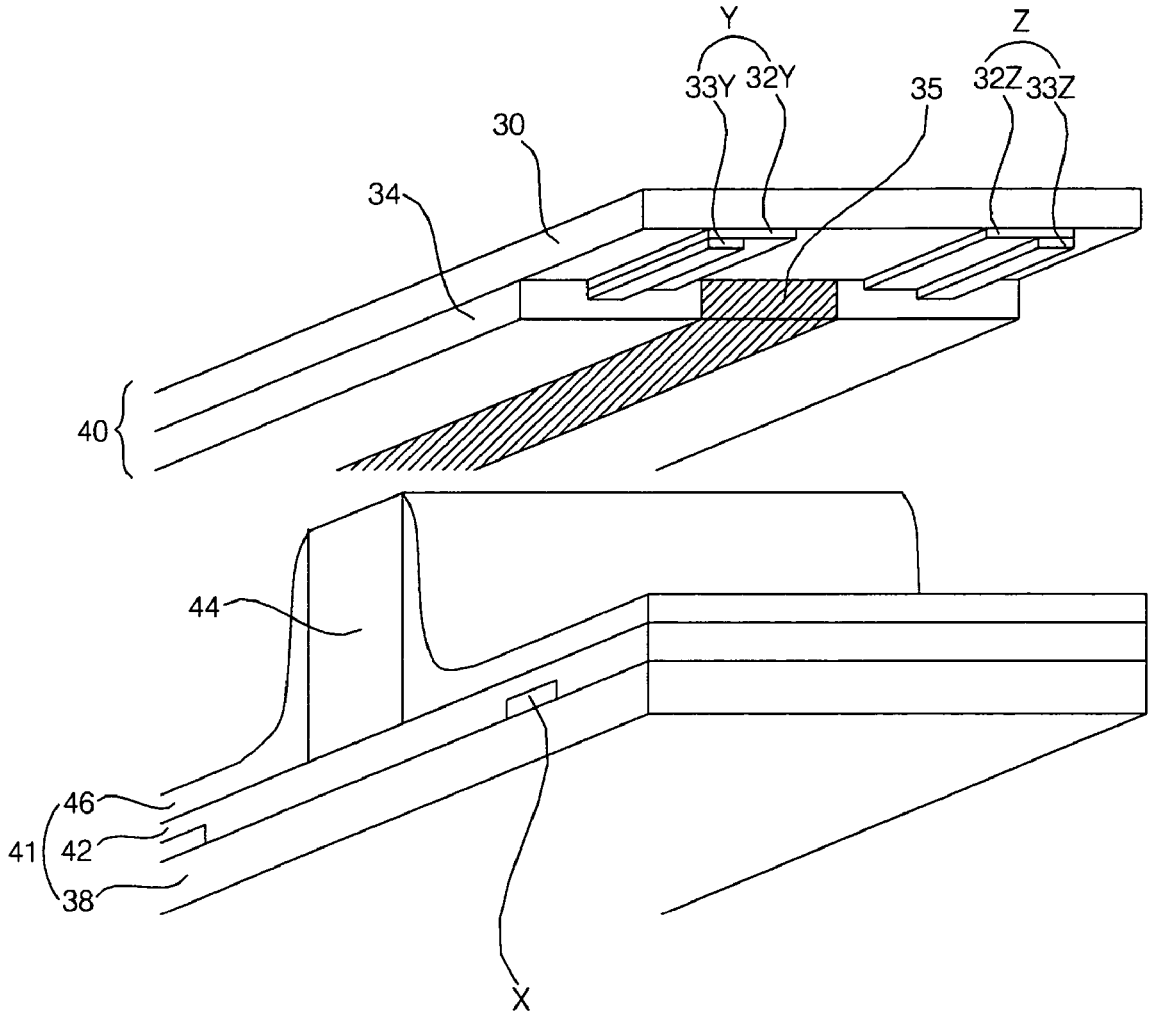
FIG. 3 is a view illustrating a plasma display apparatus according to a first embodiment of the present invention.

First, FIG. 3 is a view illustrating a plasma display apparatus according to a first embodiment of the present invention. Referring to FIG. 3, a front panel 40 of a plasma display apparatus according to the present invention includes a upper electrode pair including a scan electrode (Y) and a sustain electrode (Z) which are formed on an upper substrate 30, an address electrode formed on the lower substrate opposite to the upper substrate 30, a barrier rib formed between the upper substrate 30 and the lower substrate, and upper dielectric layers 34 and 35 formed on the upper substrate to cover the upper electrode pair (Y, Z).

Each of the scan electrode (Y) and the sustain electrode (Z) includes transparent electrodes (32Y, 32Z) and metal bus electrodes (33Y, 33Z) having a line width smaller than that of transparent electrodes (32Y, 32Z) and formed in one side edge of the transparent electrode.

The transparent electrodes (32Y, 32Z) are generally made of a metal such as an indium tin oxide (ITO), an indium zinc oxide (IZO), and an indium tin zinc oxide (ITZO) and formed on the upper substrate 30. The metal bus electrodes (33Y, 33Z) are made of a metal such as chrome (Cr) or gold (Ag) and formed on the transparent electrodes (32Y, 32Z) to reduce a drop in voltage by the transparent electrodes (32Y, 32Z) having high resistance. The upper dielectric layers 34 and 35 and the protective film 36 are stacked in the upper substrate 30 in which the scan electrode (Y) and the sustain electrode (Z) is formed in parallel.

In FIG. 3, a protective film among elements which composes a front panel 40 is not shown, but the protective film is formed on the upper dielectric layers 34 and 35, prevents damage of the upper dielectric layers 34 and 35 due to sputtering generated upon discharging plasma, and improves emission efficiency of a secondary electron. A magnesium oxide (MgO) is generally used as a protective film.

The upper dielectric layers 34 and 35 can be largely divided into a part (hereinafter, referred to as "a first dielectric part") 34 formed between the scan electrode (Y) and the sustain electrode (Z) and a part (hereinafter, referred to as "a second dielectric part") 35 formed on the scan electrode (Y) and the sustain electrode (Z).

The dielectric constant of the second dielectric part 35 is smaller than that of the first dielectric part 34.

The first dielectric part 34 accumulates wall charges formed upon discharging to lower a discharge voltage at subsequent discharge. Therefore, as a dielectric constant is high to some degree, discharge efficiency is good.

Because the second dielectric part 35 is not greatly concerned in forming wall charges, parasitic capacitance generated by the scan electrode and the sustain electrode is lowered as a dielectric constant of this unit is lowered.

In the rear substrate 41, a lower dielectric layer 42 and a barrier rib 44 are formed on the lower substrate 38 in which the address electrode (X) is formed and a phosphorous layer 46 is coated on a surface of the lower dielectric layer 42 and the barrier rib 44. The address electrode (X) is formed in a direction intersecting the scan electrode (Y) and the sustain electrode (Z).

The lower dielectric layer 42 is formed on the lower substrate 38 to cover the address electrode (X), thereby accumulating wall charges generated due to discharge. The lower dielectric layer 42 can lower a discharge voltage applied from the outside.

The barrier rib 44 (24는 오기) and the upper and lower substrates 30 and 38 partition a discharge space. The barrier rib 44 is formed in parallel to the address electrode (X) and prevents ultraviolet rays and visible rays generated by gas discharge from being leaked to the adjacent discharge cell.

An inert gas such as He, Ne, Ar, Xe, and Kr for gas discharge, a discharge gas (or mixed gas) with which these gases are combined, or an excimer gas which can generate ultraviolet rays due to discharge are filled in a discharge space formed between the upper and lower substrates 30 and 38 and the barrier rib 44.

The phosphorous layer 46 is excited by ultraviolet rays generated upon discharging plasma and generates any one visible ray among red color (R), green color (G), and blue color (B).

Figure 4:
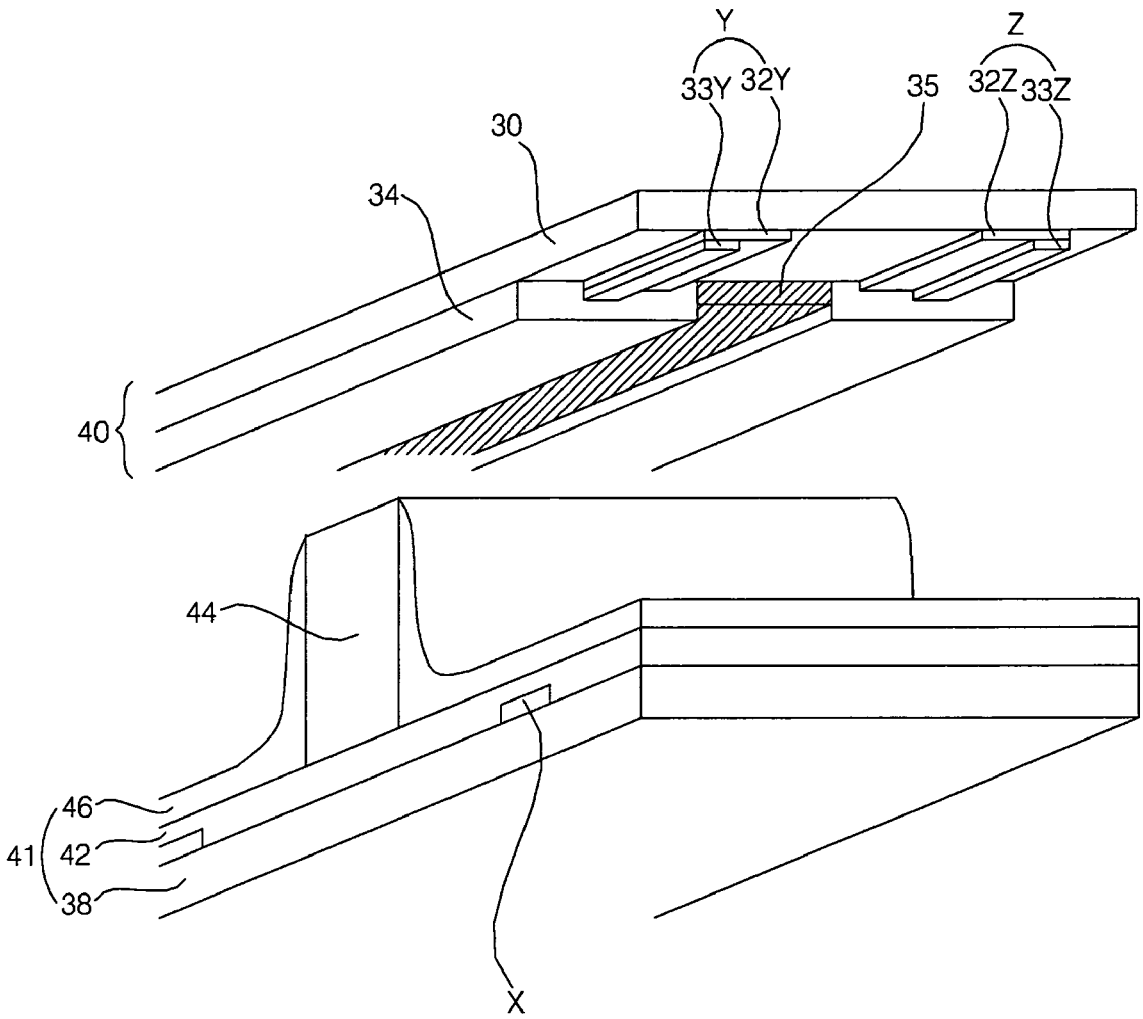
FIG. 4 is a view illustrating a plasma display apparatus according to a second embodiment of the present invention.

FIG. 4 is a view illustrating a plasma display apparatus according to a second embodiment of the present invention, where a protective film is omitted as in FIG. 3.

Referring to FIG. 4, the second embodiment of the plasma display apparatus according to the present invention is the same as the first embodiment in a basic structure, but the thicknesses of the first dielectric part 34 and the second dielectric part 35 may be formed to be different from each other in the dielectric layers 34 and 35 for covering the electrodes (Y, Z) formed in the upper substrate 30. Specifically, the thickness of the second dielectric part 35 is formed to smaller than that the first dielectric part 34.

As described above, the first dielectric part 34 is a dielectric part formed on the scan electrode (Y) and the sustain electrode (Z) and the second dielectric part 35 is a dielectric part formed between the scan electrode (Y) and the sustain electrode (Z).

Although the dielectric layers 34 and 35 are made of a material having the same dielectric constant and the thickness of the second dielectric part 35 is smaller than that of the first dielectric part 36, so that an entire dielectric constant between the scan electrode (Y) and the sustain electrode (Z) decreases and thus parasitic capacitance decreases.

In addition, the second dielectric part 35 may be made of a material having a dielectric constant smaller than that of the first dielectric part 34. In this case, parasitic capacitance can be reduced more than a case where the electric unit is made of a material having the same dielectric constant.

Figure 5:
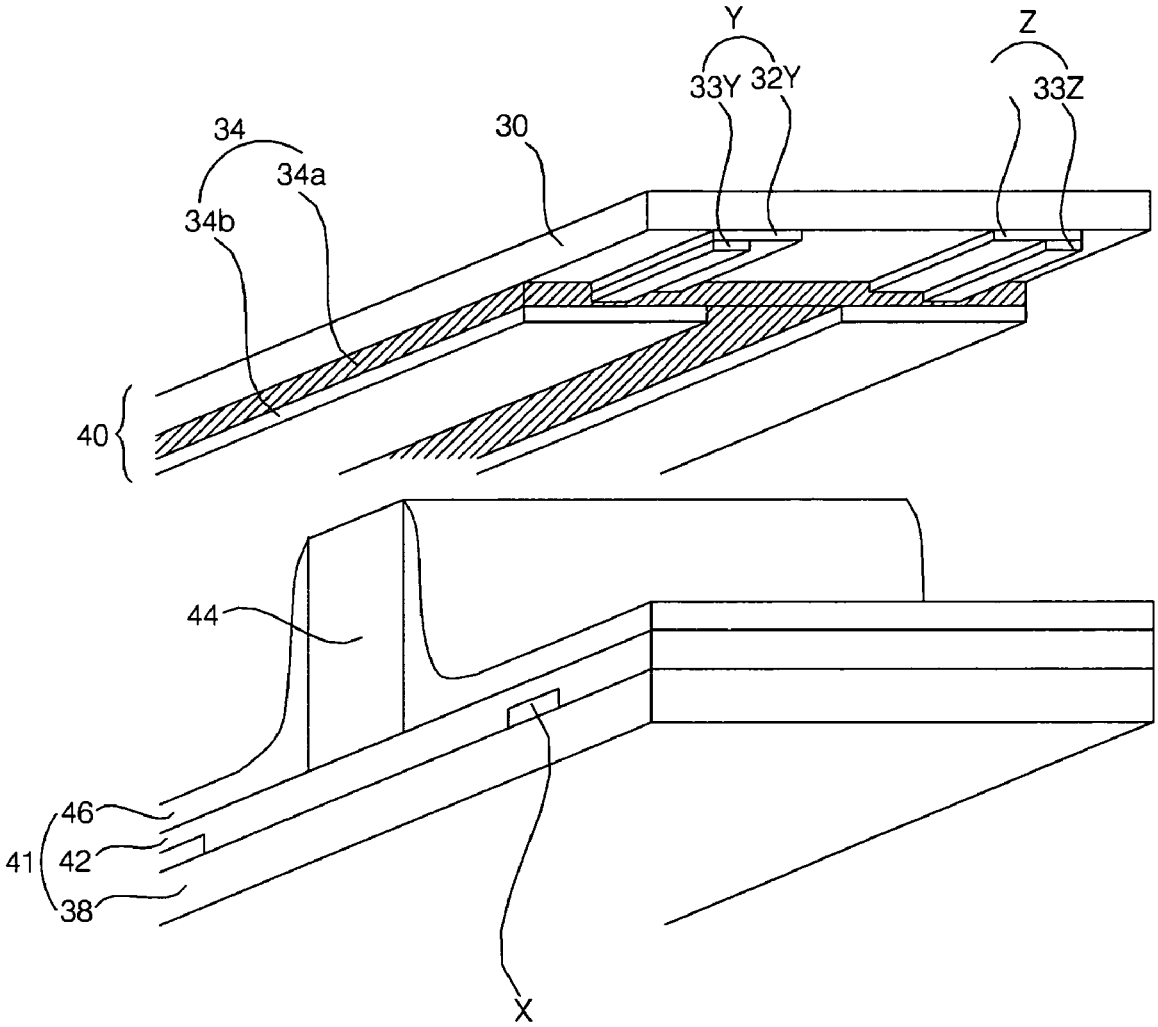
FIG. 5 is a view illustrating a plasma display apparatus according to a third embodiment of the present invention.

FIG. 5 is a view illustrating a plasma display apparatus according to a third embodiment of the present invention, where a protective film is omitted as in FIG. 3.

Referring to FIG. 5, the third embodiment of the plasma display apparatus according to the present invention is the same as the first embodiment in the basic structure, but the dielectric layer 34 for covering electrodes (Y, Z) formed in the upper substrate 30 includes a first dielectric layer 3*a* and a second dielectric layer 34*b*.

The first dielectric layer 34*a* is formed to cover an entire upper substrate including the scan electrode (Y) and the sustain electrode (Z).

The second dielectric layer 34*b* is formed to cover only an upper part of the scan electrode and the sustain electrode in order to expose the first dielectric layer 34*a* between the scan electrode and the sustain electrode.

As described above, because the upper dielectric layer 34 is composed of two layers and one dielectric layer is formed between the scan electrode and the sustain electrode, parasitic capacitance is reduced as a thickness of a dielectric layer between the electrodes becomes smaller than that of a dielectric layer of the electrodes.

In addition, a dielectric constant of the first dielectric layer 34*a* can be formed to be small than that of the second dielectric layer 34*b*. Therefore, a dielectric constant between the electrodes can be more surely lowered, thereby more increasing a decrement of parasitic capacitance.

Figure 6:
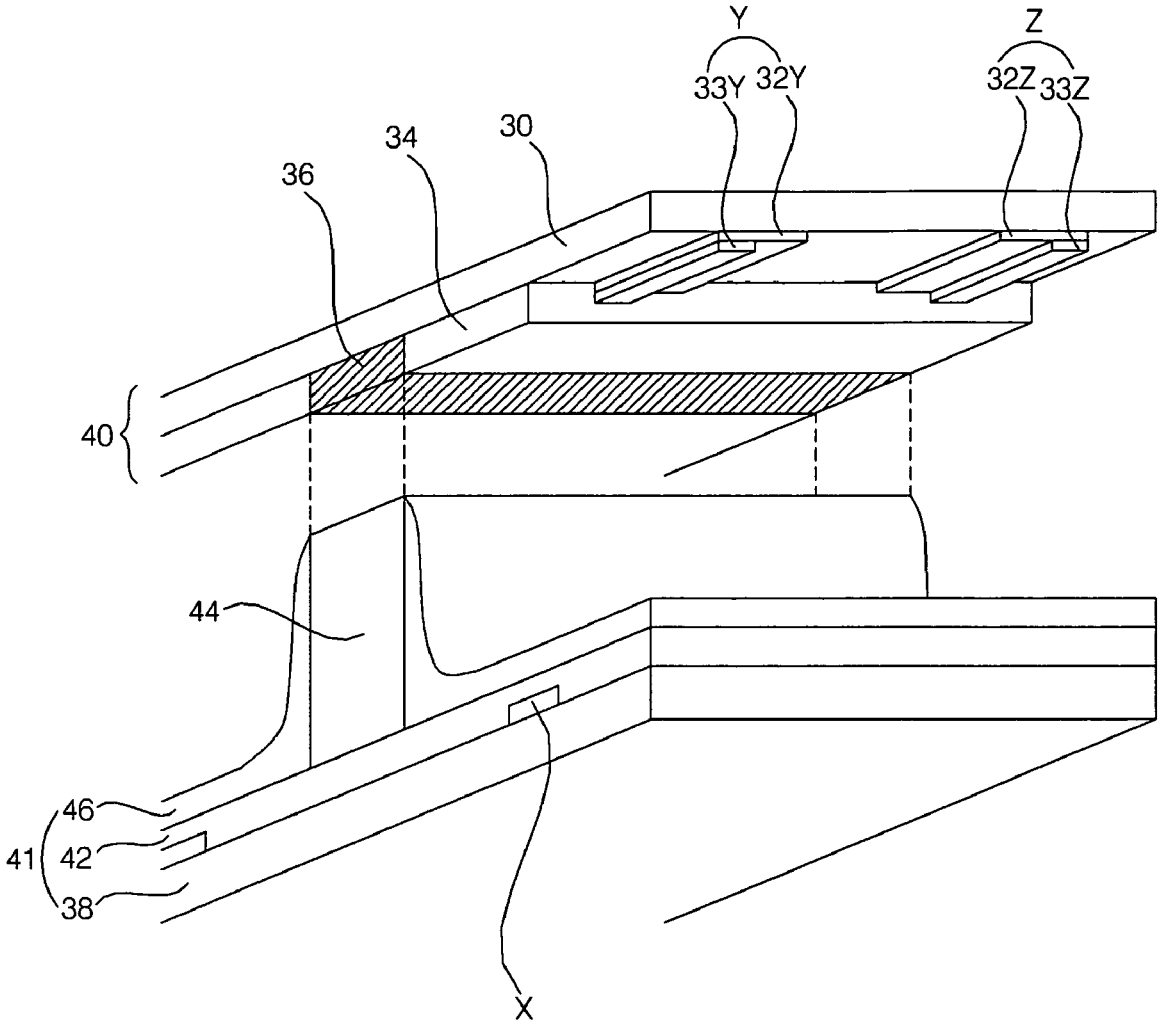
FIG. 6 is a view illustrating a plasma display apparatus according to a fourth embodiment of the present invention.

FIG. 6 is a view illustrating a plasma display apparatus according to a fourth embodiment of the present invention, where a protective film is omitted.

Referring to FIG. 6, in the fourth embodiment according to the present invention, a dielectric constant in an area where the upper dielectric layers 34 and 36 are overlapped with the barrier rib 44 is different from that in an area where they are not overlapped with the barrier rib.

That is, the upper dielectric layers 34 and 36 include a first dielectric part 34 which is not overlapped with the barrier rib and a second dielectric part 36 which is overlapped with the barrier rib.

It is characterized in that a dielectric constant of the second dielectric part 36 is smaller than that of the first dielectric part 34.

Because a dielectric constant of the second dielectric part 36 is smaller than that of the first dielectric part 34, parasitic capacitance generated in a phosphorous layer of a portion overlapped with the barrier rib is reduced. The second dielectric part 36 is a non-discharge area in which discharge is not generated and can reduce parasitic capacitance of the panel by lowering a dielectric constant of the dielectric layer in the non-discharge area.

Figure 7:
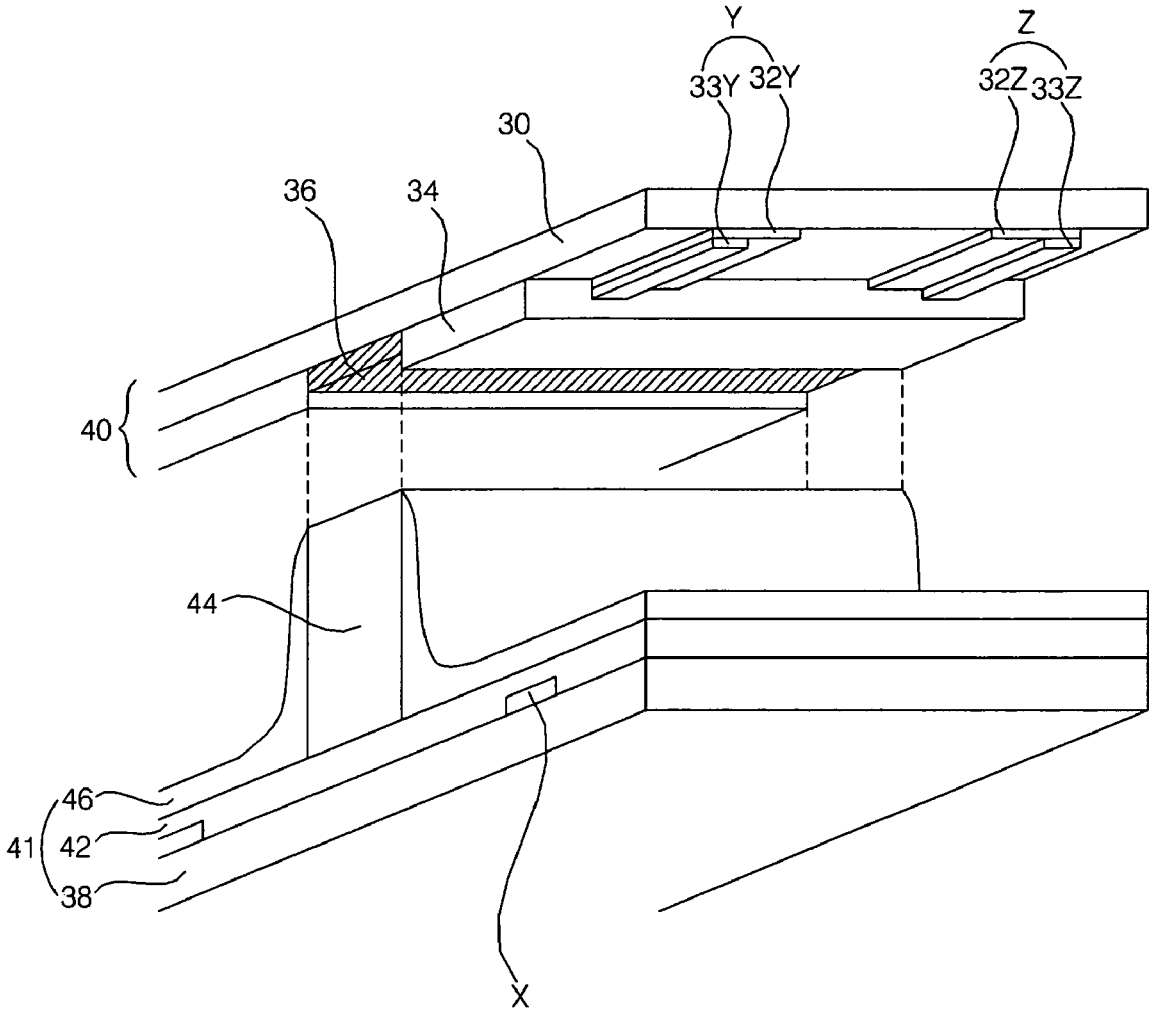
FIG. 7 is a view illustrating a plasma display apparatus according to a fifth embodiment of the present invention.

FIG. 7 is a view illustrating a plasma display apparatus according to a fifth embodiment of the present invention, where a protective film is omitted.

Referring to FIG. 7, in the fifth embodiment according to the present invention, the thickness of the dielectric layer in the area 36 in which the upper dielectric layers 34 and 36 are overlapped with the barrier rib 44 is smaller than that of the dielectric layer in the area 34 in which they are not overlapped with the barrier rib 44.

That is, the upper dielectric layers 34 and 36 include a first dielectric part 34 which is not overlapped with the barrier rib and the second dielectric part 36 which is overlapped with the barrier rib.

It is characterized in that the thickness of the second dielectric part 36 is smaller than that of the first dielectric part 34.

Because the thickness of the second dielectric part 36 is relatively small than that of the first dielectric part 34, a dielectric constant becomes also small, so that parasitic capacitance generating in a phosphorous layer of a portion which is overlapped with the barrier rib becomes also small. The second dielectric part 36 is a non-discharge area where discharge is not generated and can reduce parasitic capacitance of a panel by lowering a dielectric constant of the dielectric layer in the non-discharge area.

In this case, as the dielectric constant and the thickness of the second dielectric part 36 are set to be smaller than those of the first dielectric part 34, there is an effect that large parasitic capacitance can be reduced.

Figure 8:
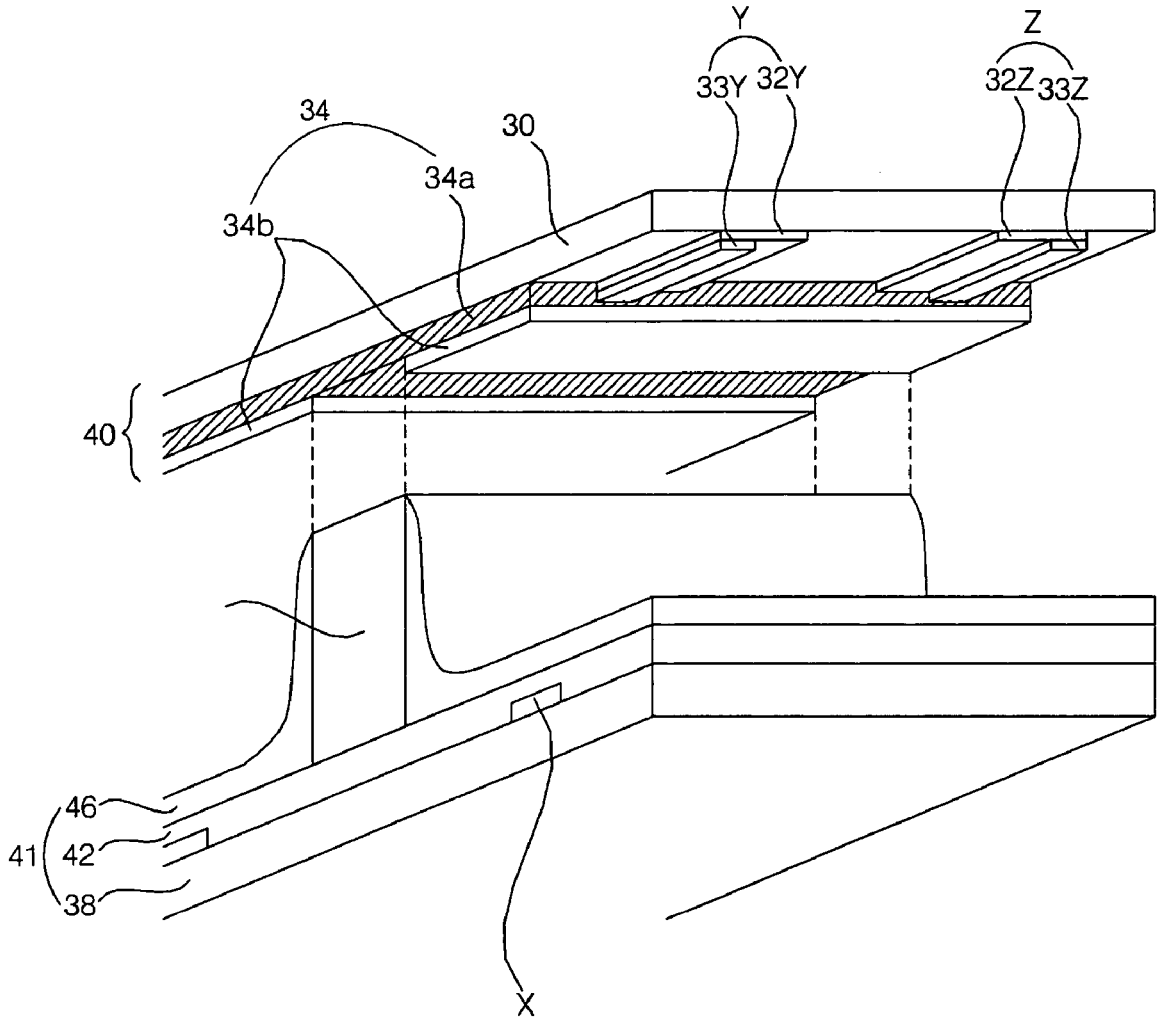
FIG. 8 is a view illustrating a plasma display apparatus according to a sixth embodiment of the present invention.

FIG. 8 is a view illustrating a plasma display apparatus according to a sixth embodiment of the present invention, where a protective film is omitted.

Referring to FIG. 8, in the sixth embodiment according to the present invention, the upper dielectric layer 34 includes a first dielectric layer 34*a* and a second dielectric layer 34*b*.

The first dielectric layer 34*a* is formed to cover an entire upper substrate including the scan electrode (Y) and the sustain electrode (Z).

The second dielectric layer 34*b* is formed in only a portion which is not overlapped with the barrier rib 44 to expose the first dielectric layer of an area overlapped with barrier rib 44.

As described above, as the upper dielectric layer 34 is composed of two layers and one dielectric layer is formed in an area overlapped with the barrier rib 44, a thickness of a dielectric layer in a portion overlapped with the barrier rib 44 becomes small, so that parasitic capacitance becomes small.

In addition, a dielectric constant of the first dielectric layer 34*a* can be formed to be smaller than that of the second dielectric layer 34*b*. Therefore, as a dielectric constant between the electrodes can be more surely lowered, a decrement of parasitic capacitance further increases.

All, each, or a combined one of the first embodiment to the sixth embodiment can be preformed, but the present invention is not limited to this.

Figure 9:
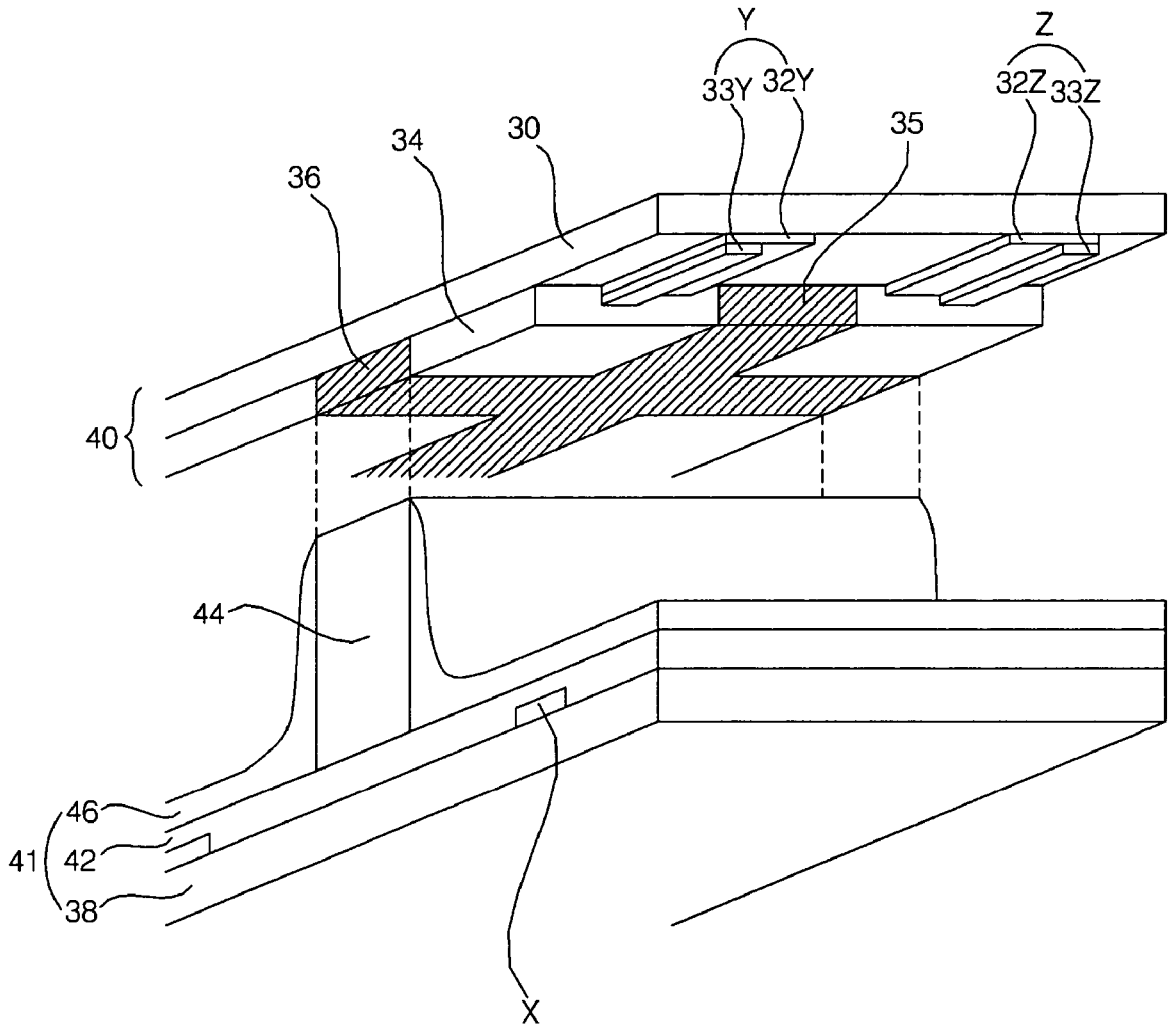
FIG. 9 is a view illustrating a plasma display apparatus according to a seventh embodiment of the present invention.

FIG. 9 is a view illustrating a plasma display apparatus according to a seventh embodiment of the present invention, where a protective film is omitted.

Referring to FIG. 9, in the seventh embodiment according to the present invention, in the upper dielectric layers 34, 35, and 36, a dielectric constant in a portion 35 between the scan electrode (Y) and the sustain electrode (Z) is smaller than that in a portion 34 on the scan electrode (Y) and the sustain electrode (Z) and a dielectric constant in a portion 36 that is overlapped with the barrier rib 44 is smaller than that in the portion 34 that is not overlapped with the barrier rib 44.

That is, the upper dielectric layer is composed so that a dielectric constant in the portion 35 between the scan electrode and the sustain electrode and the portion 36 that is overlapped with the barrier rib 44 is smaller than that of the other portion 34.

Because such a construction has a direct influence on discharge in a discharge space, a dielectric constant can be lowered in a portion except a portion in which wall charges are formed, so that parasitic capacitance of a panel is reduced.

Figure 10:
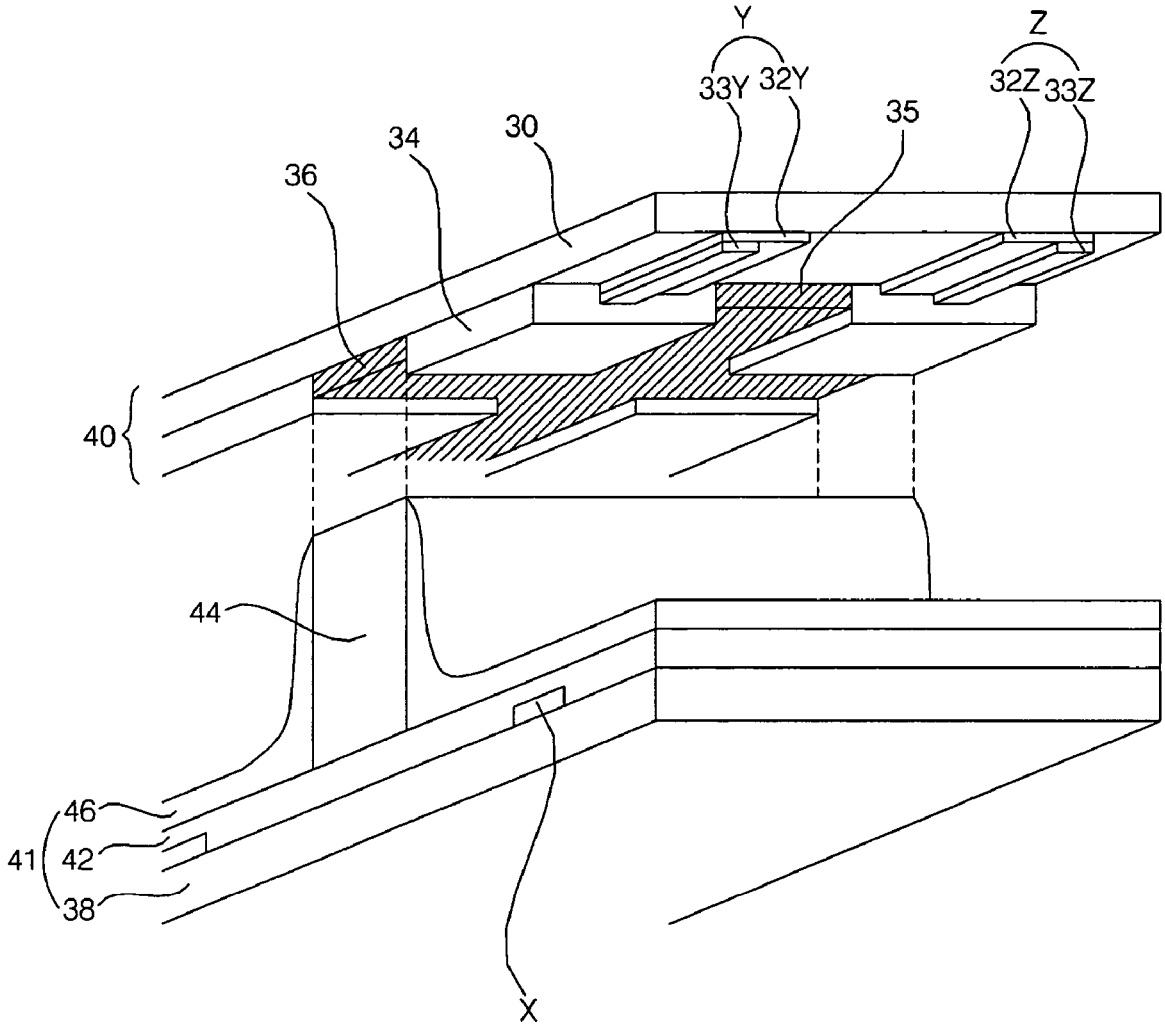
FIG. 10 is a view illustrating a plasma display apparatus according to an eighth embodiment of the present invention.

FIG. 10 is a view illustrating a plasma display apparatus according to an eighth embodiment of the present invention, where a protective film is omitted.

Referring to FIG. 10, in the eighth embodiment according to the present invention, it is characterized in that a thickness of a dielectric layer of a portion 35 between the scan electrode (Y) and the sustain electrode (Z) and a portion 36 that is overlapped with the barrier rib 44 in the upper dielectric layers 34, 35, and 36 is formed to be smaller than that of a dielectric layer 34 of other portion.

Because portions 35 and 36 having a small thickness has a smaller dielectric constant than the portion 34 having a large thickness, a value of parasitic capacitance is reduced.

In addition, a dielectric layers of the portion 35 between the scan electrode (Y) and the sustain electrode (Z) and the portion 36 that is overlapped with the barrier rib 44 can be made of a material having a dielectric constant smaller than that of other portion 34. In this case, it is possible to more effectively lower parasitic capacitance.

Because such a construction has a direct influence on discharge in a discharge space, a dielectric constant can be lowered in a portion except a portion in which wall charges are formed, so that it is possible to reduce parasitic capacitance of a panel.

Figure 11:
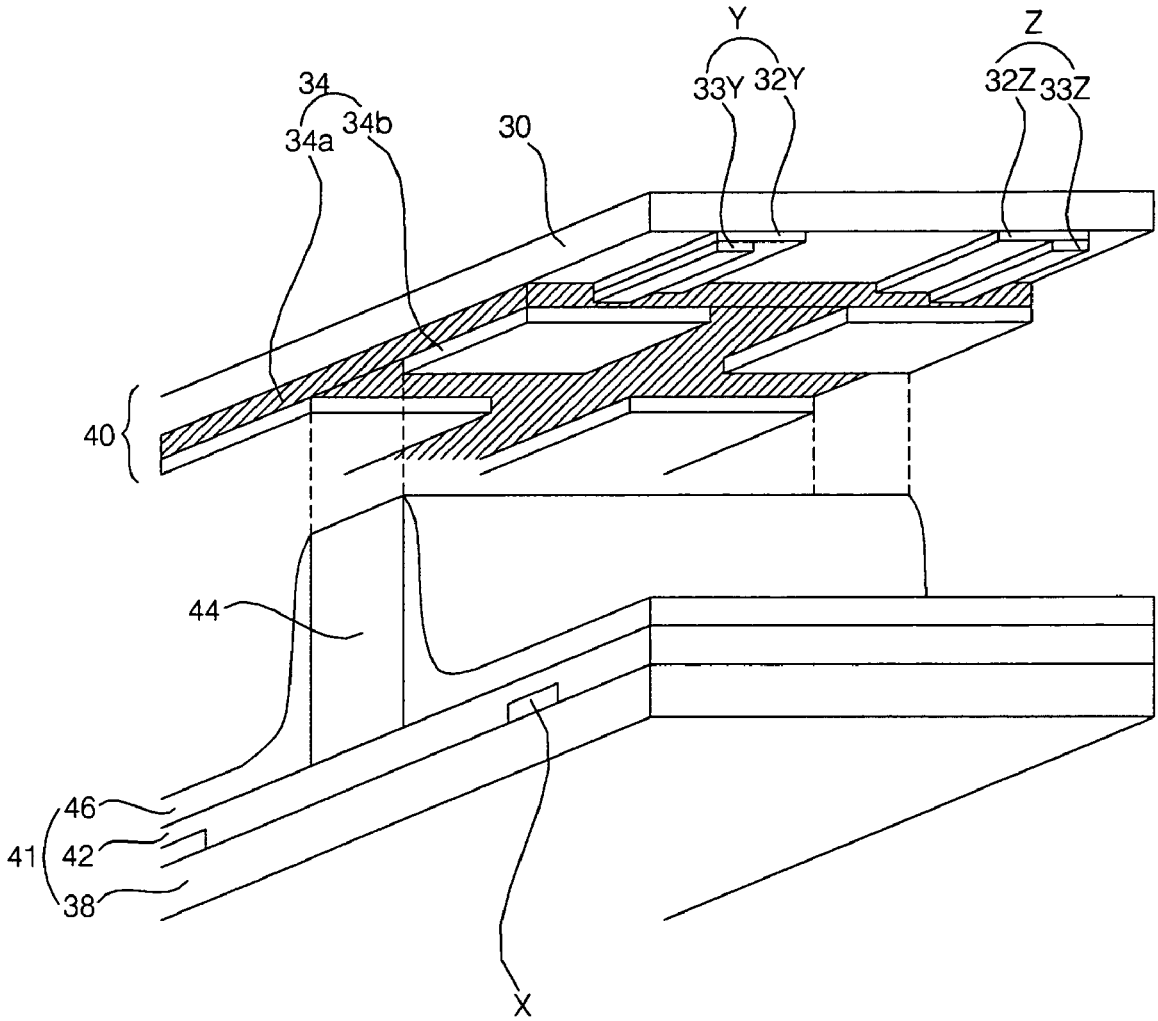
FIG. 11 is a view illustrating a plasma display apparatus according to a ninth embodiment of the present invention.

FIG. 11 is a view illustrating a plasma display apparatus according to a ninth embodiment of the present invention, where a protective film is omitted.

Referring to FIG. 11, in the ninth embodiment according to the present invention, the upper dielectric layer 34 includes a first dielectric layer 34*a* and a second dielectric layer 34*b*.

The first dielectric layer 34*a* is formed to cover an entire upper substrate including the scan electrode (Y), the sustain electrode (Z), and a portion overlapped with barrier rib 44.

The second dielectric layer 34*b* is formed to expose the first dielectric layer 34*a* between the scan electrode (Y) and the sustain electrode (Z) and to expose the first dielectric layer 34*a* of a portion overlapped with the barrier rib 44.

As described above, as the upper dielectric layer 34 is composed of two layers and one dielectric layer is formed in a portion between the electrodes and in a portion overlapped with the barrier rib 44, a thickness of a dielectric layer is small in a portion between the electrodes and in a portion overlapped with the barrier rib 44, so that parasitic capacitance is reduced.

In addition, the dielectric constant of the first dielectric layer 34*a* can be formed to be small than that of the second dielectric layer 34*b*. Therefore, it is possible to more surely lower a dielectric constant between the electrodes and thus a decrement of parasitic capacitance further increases.

FIGS. 12A to 12E are views schematically illustrating an embodiment of a process for manufacturing a plasma display apparatus according to the present invention.

FIGS. 12A to 12E show processes of an embodiment in which the first embodiment to the fifth embodiment are combined. At this process, it is characterized in that a dielectric constant of a dielectric layer changes by irradiating light in a desired portion using a mask and it can be applied to all of the first embodiment to the ninth embodiment.

Figure 12A:
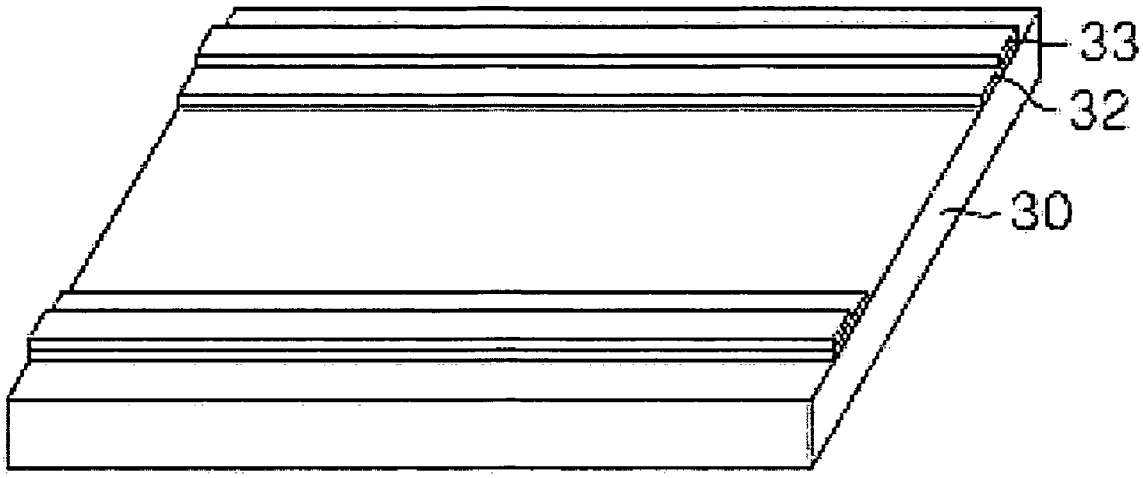
FIGS. 12A to 12E are views schematically illustrating processes for manufacturing a plasma display apparatus according to the present invention.
Figure 12B:
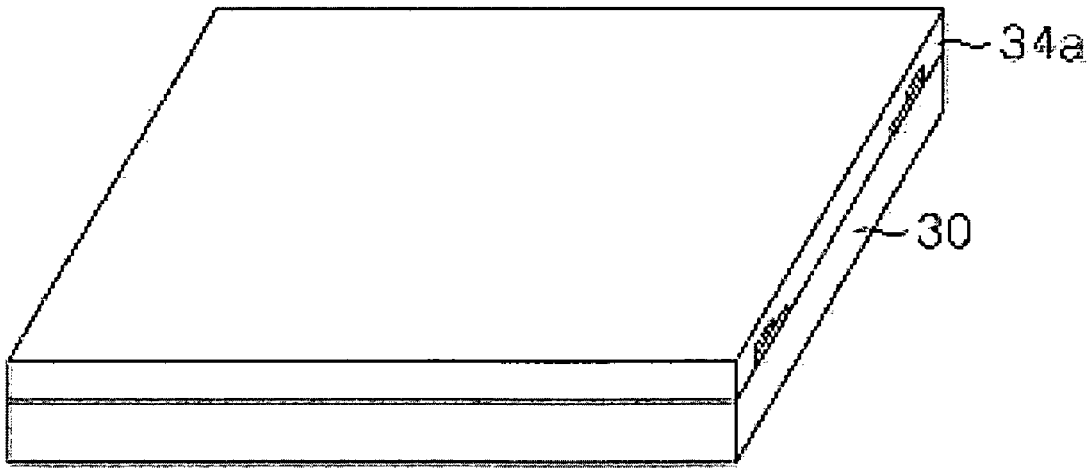

As shown in FIG. 12A, the transparent electrode 32 and the metal bus electrode 33 are sequentially formed on the upper substrate 30. As shown in FIG. 12B, one first layer 34*a* is first formed on the front surface of the upper substrate 30 in which the transparent electrode 32 and the metal bus electrode 33 are formed.

Figure 12C:
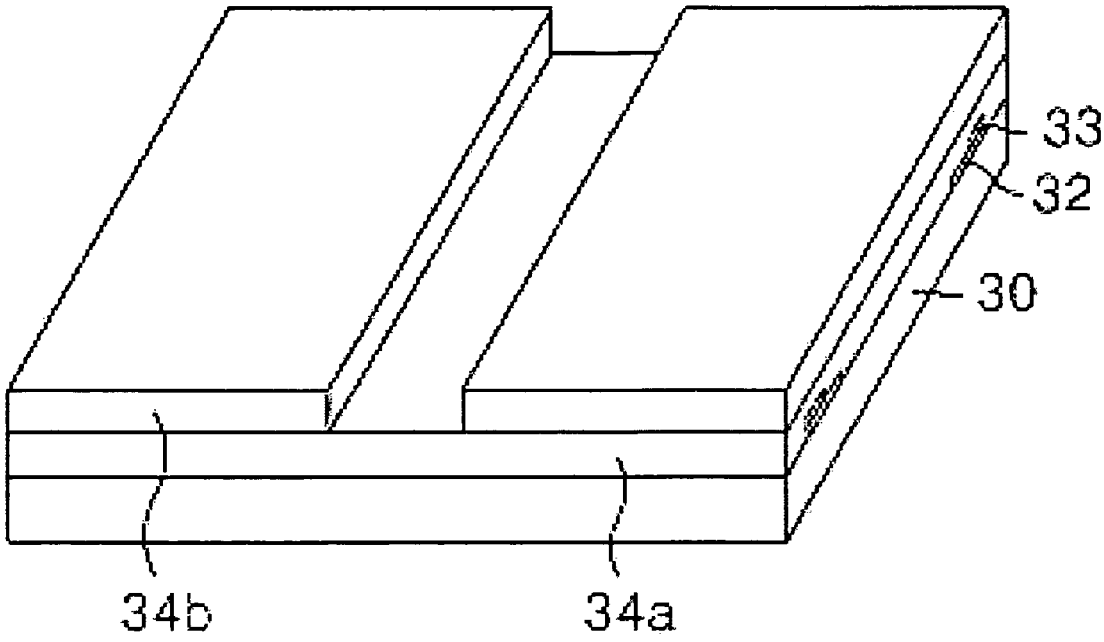

When the first layer 34*a* is formed, the second layer 34*b* is selectively formed on the first layer 34 as in FIG. 12C.

At this time, the second layer 34*b* is not formed in a portion overlapped with the barrier rib 44 so that a thickness of a dielectric layer of a portion which is overlapped with the barrier rib 44 is smaller than that of a portion which is not overlapped with the barrier rib 44, i.e., a thickness of a dielectric layer of a discharge area.

Figure 12D:
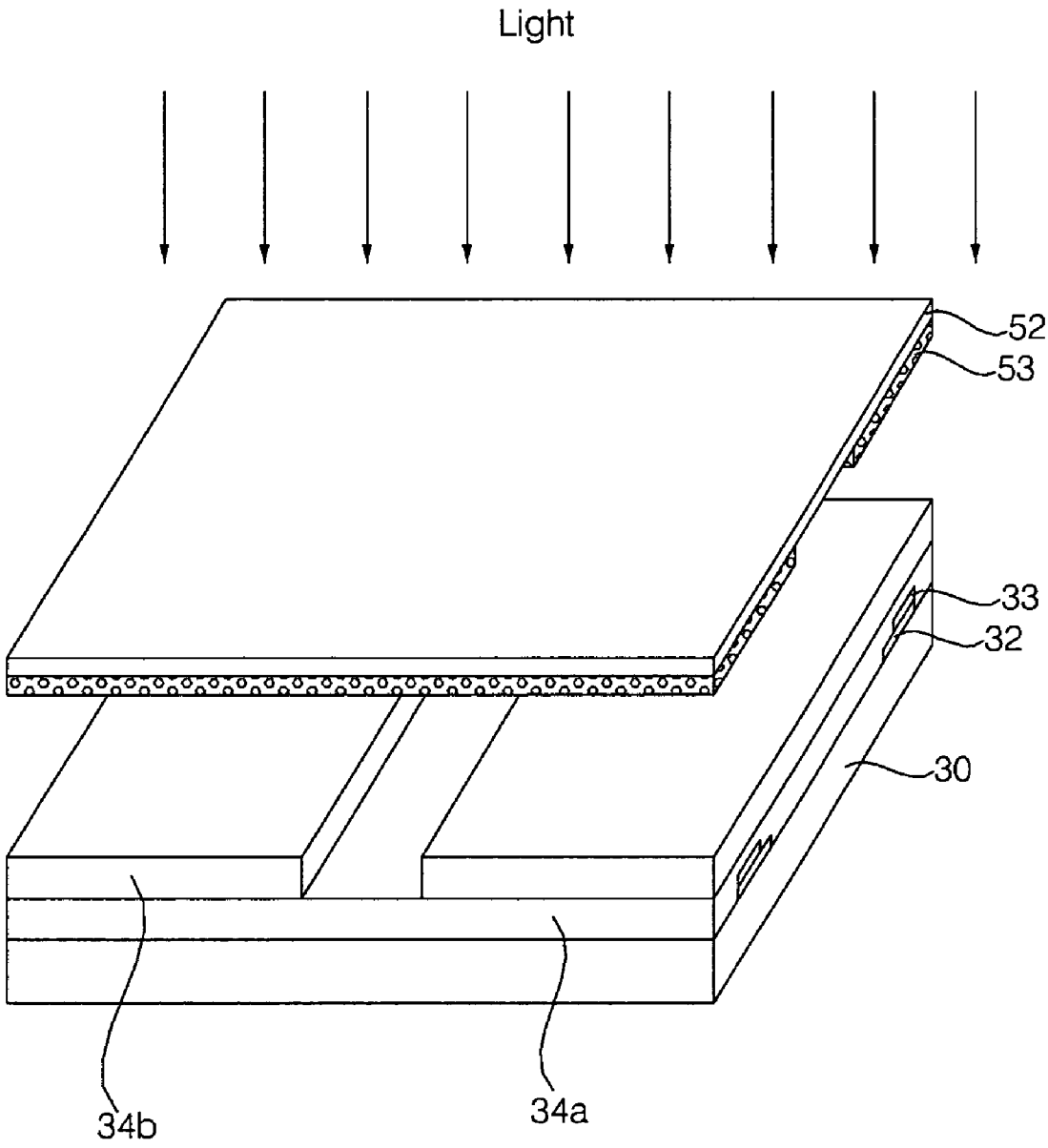

When the first dielectric part is formed by the first and second layers 34*a* and 34*b*, a mask 52 in which the light shielding layer 53 is partially formed is positioned on the dielectric layer 34 as in FIG. 12D.

The mask 52 forms a transmitting part by the light shielding layer 53 and light is irradiated to a desired part of a dielectric layer through a transmitting part of the mask 52.

Figure 12E:
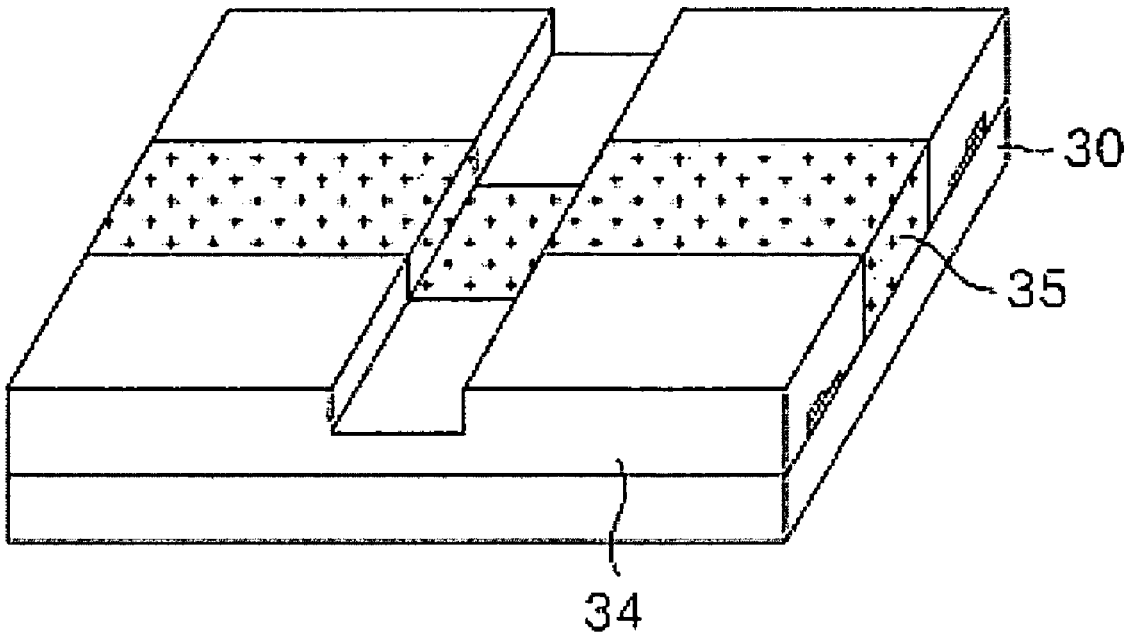

The second dielectric part 35 is formed in a portion to which light of the dielectric layer is irradiated as a dielectric constant changes by irradiated light as in FIG. 12E. At this time, the light shielding layer 53 of the mask 52 is positioned on the electrodes 32 and 33 to form a transmitting part in a portion between electrodes 32 and 33 or it is positioned in a portion between the electrodes 32 and 33 to form the transmitting part in the upper area of electrodes 32 and 33. This is selected by considering a dielectric constant of a dielectric layer changing depending on irradiation of light.

As described above, the plasma display apparatus according to the present invention is formed by changing a dielectric layer formed on the scan electrode and the sustain electrode and a dielectric constant of a dielectric layer formed between these electrodes. In addition, a dielectric constant of a dielectric layer in a portion in which these dielectric layers are overlapped with the barrier rib is formed to be different from that of a dielectric layer in other area.

Therefore, according to the plasma display apparatus of the present invention, it is possible to reduce parasitic capacitance formed between the scan electrode and the sustain electrode and a parasitic capacitance formed on a barrier rib. In addition, it is possible to reduce a magnitude of a voltage required for discharge by reducing parasitic capacitance and thus to reduce consumption power.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

an upper electrode pair including a scan electrode and a sustain electrode which are formed on an upper substrate;

an address electrode formed on a lower substrate opposite to the upper substrate;

a barrier rib formed between the upper substrate and the lower substrate; and a dielectric layer which is formed on the upper substrate to cover the upper electrode pair, wherein the dielectric layer comprises:

a first layer having a first dielectric constant; and a second layer having a second dielectric constant, wherein the second dielectric constant is different than the first dielectric constant, the first and second layers of the dielectric layer are positioned immediately adjacent to one another, and the first layer is provided on a surface of the upper substrate covering the upper substrate and the upper electrode pair, and the second layer is formed on a portion of the first layer that extends between and in parallel to adjacent barrier ribs such that a thickness of the dielectric layer in an area that overlaps the barrier rib is less than a thickness of the dielectric layer in an area between adjacent barrier ribs.

2. The plasma display apparatus of claim 1, wherein the first layer includes:

a first surface that is positioned immediately adjacent to the upper substrate and the upper electrode pair so as to cover the upper substrate and the upper electrode pair; and a second surface that is opposite the first surface; and the second layer includes first and second portions each including:

a first surface that is positioned immediately adjacent to the second surface of the first layer; and a second surface that is opposite the first surface and that faces the lower substrate.

3. The plasma display apparatus of claim 2, wherein the first and second portions of the second layer extend along the second surface of the first layer in a direction and area corresponding to spaces formed between adjacent barrier ribs and perpendicular to the upper electrode pair such that a portion of the first layer exposed therebetween overlaps the barrier rib.

4. The plasma display apparatus of claim 1, wherein a material of the first layer is different than a material of the second layer.

5. A plasma display apparatus, comprising:

an upper electrode pair including a scan electrode and a sustain electrode provided on an upper substrate;

an address electrode provided on a lower substrate opposite to the upper substrate;

a barrier rib provided between the upper substrate and the lower substrate; and a dielectric layer that covers the upper electrode pair and a corresponding surface of the upper substrate, wherein the dielectric layer comprises:

a first layer; and a second layer that includes a groove area, wherein the first layer comprises:

a first surface positioned immediately adjacent to the upper electrode pair and a corresponding surface of the upper substrate; and a second surface opposite the first surface, and wherein the second layer includes first and second portions each comprising:

a first surface positioned immediately adjacent to the second surface of the first layer; and a second surface opposite the first surface and facing the lower substrate, wherein the first and second portions are spaced apart so as to form the groove area therebetween such that the first layer is exposed through the groove portion, and wherein the first layer is provided on a surface of the upper substrate covering the upper substrate and the upper electrode pair, and the second layer is formed on a portion of the first layer that extends between and in parallel to adjacent barrier ribs such that a thickness of the dielectric layer in an area that overlaps the barrier rib is less than a thickness of the dielectric layer in an area between adjacent barrier ribs.

6. The plasma display apparatus of claim 5, wherein the first and second layers are positioned perpendicular to the upper electrode pair and parallel to the barrier rib, and wherein at least one of a thickness of the second layer is less than that of the first layer, a dielectric constant of the second layer is less than that of the first layer, or a material of the second layer is different than that of the first layer.

* * * * *